US008833963B2

(12) United States Patent
Opolka

(10) Patent No.: US 8,833,963 B2
(45) Date of Patent: Sep. 16, 2014

(54) FLASHLIGHT WITH A BATTERY CARTRIDGE

(75) Inventor: Rainer Opolka, Solingen (DE)

(73) Assignee: Zweibrueder Optoelectronics GmbH & Co. KG, Solingen (DE)

( * ) Notice: Subject to any disclaimer, the term of this patent is extended or adjusted under 35 U.S.C. 154(b) by 0 days.

(21) Appl. No.: 13/695,817

(22) PCT Filed: May 12, 2011

(86) PCT No.: PCT/DE2011/001064
§ 371 (c)(1),
(2), (4) Date: Nov. 2, 2012

(87) PCT Pub. No.: WO2012/003819
PCT Pub. Date: Jan. 12, 2012

(65) Prior Publication Data

US 2013/0094197 A1 Apr. 18, 2013

(30) Foreign Application Priority Data

Jul. 6, 2010 (DE) ..... 10 2010 026 161

(51) Int. Cl.

| | |
|---|---|
| ***F21L 4/04*** | (2006.01) |
| ***F21L 4/00*** | (2006.01) |
| ***F21V 23/04*** | (2006.01) |
| *F21Y 101/02* | (2006.01) |

(52) U.S. Cl.
CPC ..... *F21L 4/00* (2013.01); *F21Y 2101/02* (2013.01); *F21V 23/0414* (2013.01)
USPC ..... 362/205; 362/202; 362/206

(58) Field of Classification Search
CPC ..... F21L 4/005; F21L 4/00; F21L 4/04; F21L 15/06
USPC ..... 362/202, 205, 206
See application file for complete search history.

(56) References Cited

U.S. PATENT DOCUMENTS

| | | | | |
|---|---|---|---|---|
| 4,628,418 | A * | 12/1986 | Chabria | 362/116 |
| 6,536,912 | B2 * | 3/2003 | Parker | 362/206 |
| 6,880,951 | B2 * | 4/2005 | Yoon | 362/206 |
| 7,635,197 | B2 * | 12/2009 | Man | 362/202 |
| 7,850,332 | B2 | 12/2010 | Opolka | |

* cited by examiner

*Primary Examiner* — John A Ward
(74) *Attorney, Agent, or Firm* — Andrew Wilford

(57) ABSTRACT

The present invention relates to a flashlight with a cylindrical housing and a battery cartridge housed therein so that at least one battery can be removably retained. In order to provide a flashlight in which a faulty slide switch can be fitted or replaced simply and without any extra cost, according to the invention a slide switch is proposed with a slide mounted movably on the housing and a switch lever arranged on the battery cartridge.

7 Claims, 1 Drawing Sheet

FLASHLIGHT WITH A BATTERY CARTRIDGE

CROSS REFERENCE TO RELATED APPLICATIONS

This application is the US-national stage of PCT application PCT/DE2011/001064 filed 12 May 2011, published 12 Jan. 2012 as WO2012/003819, and claiming the priority of German patent application 102010026161.0 itself filed 6 Jul. 2010.

FIELD OF THE INVENTION

The present invention relates to a flashlight with a cylindrical housing and a battery cartridge housed therein such that at least one battery can be removably retained.

BACKGROUND OF THE INVENTION

A generic flashlight with a battery cartridge is described, for example, in DE 10 2007 032 003.7 [U.S. Pat. No. 7,850,332]. The battery cartridge has a pressure or contact switch, arranged at its end, that is activated by a push button situated on the housing.

Flashlights are moreover known from the prior art that have a slide switch situated on the housing and usually activated by the thumb. Such flashlights with a slide switch are very popular because they are convenient to use.

Slide switches are, however, generally arranged in the front region of the battery housing, where it is relatively complicated and expensive to fit them. It is thus correspondingly costly to replace a faulty slide switch, with the result that the whole flashlight is often replaced, even though in many cases only worn parts need to be replaced. For these reasons, a faulty slide switch is particularly disadvantageous in the case of flashlights with a high-value housing.

OBJECT OF THE INVENTION

The object of the present invention is therefore to provide a flashlight in which a faulty slide switch can be fitted or replaced simply and without any extra cost.

SUMMARY OF THE INVENTION

This object is achieved by the flashlight according to the invention in which a slide switch is provided which has a slide mounted movably on the housing and a switch lever arranged on the battery cartridge. In other words, the slide switch has two elements, wherein an operating element in the form of a slide is formed on the housing and the contact element in the form of a switch lever is formed on the battery cartridge. The mechanics of the contact element can thus be fitted outside the housing. In addition, worn parts such as, for example, the switch lever can be replaced simply and without any extra cost.

According to a preferred embodiment, it is provided that an electrical contact element is formed on the switch lever and an electrical contact surface is formed on the battery cartridge. A circuit can thus be closed by a pivoting movement of the switch lever, the contact element being pressed against the contact surface. The pivot lever thus simultaneously serves as an electrical conductor. Alternatively, the contact element can also be designed in such a way that two contact surfaces situated apart from each other on the battery cartridge are connected to each other. The pivot lever is here preferably designed as an insulator.

According to another preferred embodiment, it is provided that a mechanical contact element is formed on the underside of the slide and bears against the switch lever in the installed state. As a result of a sliding motion of the slide, the switch lever can be correspondingly pressed against the contact surface of the battery cartridge. To do this, the switch lever preferably has an upslope, a curved raised portion and a portion that is lower in height than the raised portion. This design of the switch lever is particularly advantageous because the switch both has a momentary-on function and can be switched on continuously. When the slide is activated, the mechanical contact element slides on the upslope of the switch lever and presses the latter with the contact element against the contact surface. As long as the mechanical contact element has not passed the curved raised portion, the switch slides back into the starting position when it is released, the electrical contact not being closed, thereby creating a momentary-on function. As soon as the mechanical contact element has passed the curved recess, the switch snaps into place so that the electrical contact is permanently closed. The electrical contact can only be opened by the return of the slide.

In order to enable the battery cartridge to be positioned precisely in the battery housing, it is preferably provided that guide elements are arranged on the battery cartridge and on the inner shell of the housing. Moreover, according to an advantageous development, a gripping element is arranged at the end of the battery cartridge, which makes it easier to fit the battery cartridge and extract it from the battery housing.

BRIEF DESCRIPTION OF THE DRAWING

Further preferred embodiments are explained below with the aid of the drawings, in which.

SPECIFIC DESCRIPTION OF THE INVENTION

Figure 1A:
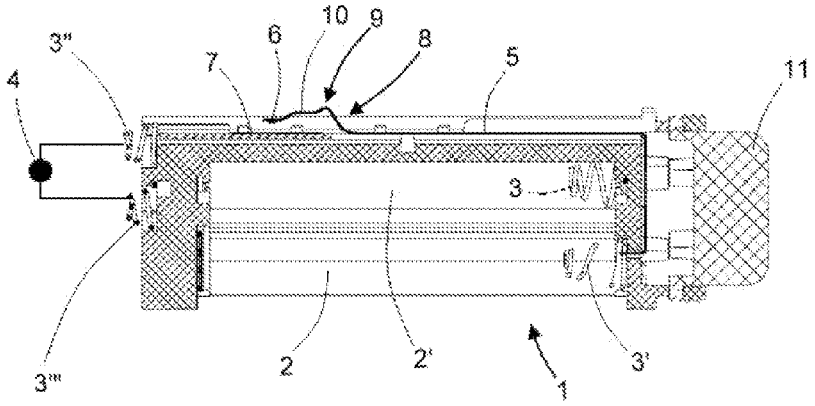
FIG. 1*a* shows a battery cartridge in a side view.
Figure 1B:
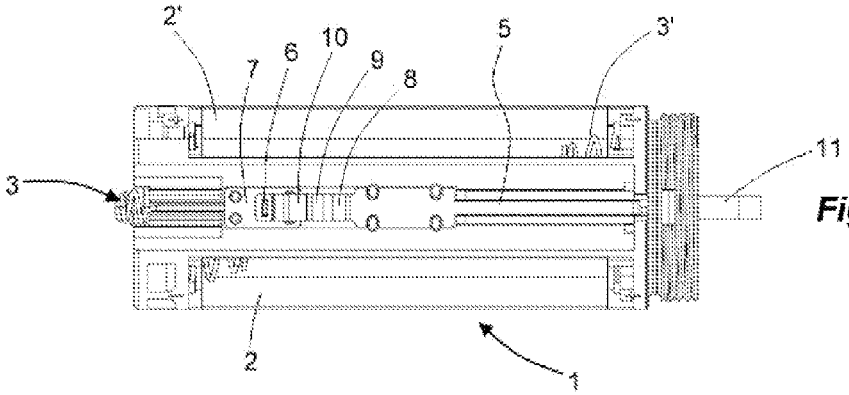
FIG. 1*b* shows a battery cartridge in a view from above.

The battery cartridge 1 has multiple recesses 2, 2' for receiving batteries that are electrically connected to one another via corresponding contact elements 3, 3', 3", 3'" so that a closed circuit results by means of which a light source 4, for example an LED, can be operated. A switch, which has a slide (not shown in FIGS. 1*a* and *b*) and a switch lever 5 arranged on the battery cartridge 1, is provided so that the circuit can be closed and opened. In the case shown, the lever arm 5 is designed as part of the circuit and has on the underside at its end an electrical contact element 6 that can be connected to an electrical contact surface 7 on the battery cartridge. To do this, the switch lever 5 is pivotably mounted and has an upslope 8, a curved raised portion 9 and a portion 10 that is lower in height than the raised portion 9. The switch lever 5 is pressed with its contact element 6 against the electrical contact surface 7 by means of a slide 20 (cf FIG. 2) and a mechanical contact element 21 that is arranged thereon and slides on the upslope 8. The switch thus functions as a combined momentary-on button and a permanent switch. As long as the mechanical contact element 21 has not yet passed the curved raised portion 9 during the switching process, the switch serves as a momentary-on button.

Figure 2:
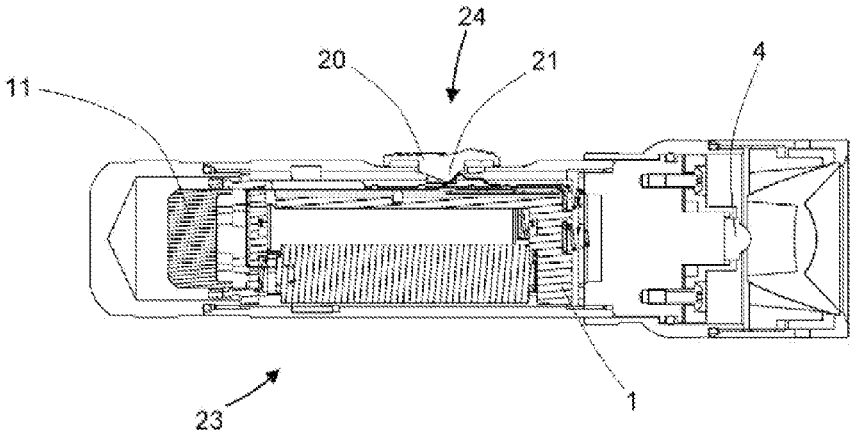
FIG. 2 shows a flashlight with a slide switch and battery cartridge.

The flashlight 23 is shown in FIG. 2 with an installed battery cartridge 1 and switch 34.

The invention claimed is:

1. A flashlight comprising:

a cylindrical housing;

a battery cartridge housed therein so that at least one battery can be removably retained;

a contact on the cartridge forming part of a circuit of the flashlight; and a slide switch having a slide mounted and slidable on the housing and a switch lever mounted pivotably on the battery cartridge and forming another contact engageable on sliding of the slide with the contact on the cartridge.

2. The flashlight as claimed in claim 1, wherein a mechanical contact element is formed on the underside of the slide and bears against the switch lever in the installed state.

3. The flashlight as claimed in claim 1, wherein guide elements are arranged on the battery cartridge and on the inner shell of the housing so that the battery cartridge can be inserted precisely into the housing.

4. The flashlight as claimed in claim 1, further comprising:

a gripper element arranged at the end of the battery cartridge.

5. The flashlight as claimed in claim 1, wherein the slide moved longitudinally and axially of the housing and the lever arm moves transversely and radially of the housing.

6. The flashlight as claimed in claim 5, wherein the slide is permanently mounted on the housing and the lever arm is permanently mounted on the cartridge.

7. A flashlight comprising:

a cylindrical housing;

a battery cartridge housed therein so that at least one battery can be removably retained; and a slide switch having a slide mounted movably on the housing and a switch lever mounted pivotably on the battery cartridge and having an upslope, a curved raised portion and a portion that is lower in height than the raised portion.

* * * * *